United States Patent [19]

Thibault

[11] Patent Number: 5,016,767

[45] Date of Patent: May 21, 1991

[54] BOOM ARTICULATION MECHANISM WITH, SIMULTANEOUSLY OPERABLE, CYLINDERS

[75] Inventor: Francois Thibault, Victoriaville, Canada

[73] Assignee: Posi-Plus Technologies Inc., Victoriaville, Canada

[21] Appl. No.: 321,386

[22] Filed: Mar. 10, 1989

[51] Int. Cl.[5] ..... B66C 23/42

[52] U.S. Cl. ..... 212/188; 212/187; 212/261; 182/2

[58] Field of Search ..... 212/163, 164, 188, 261, 212/187; 182/2; 52/117

[56] References Cited

U.S. PATENT DOCUMENTS

| | | | |
|---|---|---|---|
| 3,108,655 | 10/1963 | Troche | 182/2 |
| 3,108,656 | 10/1963 | Asplundh | 182/2 |
| 3,235,097 | 2/1966 | Ohman | 212/188 |
| 4,185,427 | 1/1980 | Raymond . | |
| 4,461,369 | 7/1984 | Amador | 182/2 |
| 4,534,444 | 8/1985 | Smith | 182/2 |
| 4,602,462 | 7/1986 | Anderson . | |
| 4,775,029 | 10/1988 | MacDonald et al. | 52/117 |

FOREIGN PATENT DOCUMENTS

| | | | |
|---|---|---|---|
| 2353137 | 4/1975 | Fed. Rep. of Germany | 212/164 |

*Primary Examiner*—Sherman Basinger

*Assistant Examiner*—Thomas J. Brahan

*Attorney, Agent, or Firm*—Oblon, Spivak, McClelland, Maier & Neustadt

[57] ABSTRACT

A boom articulation mechanism for interconnecting and displacing a pair of boom members. The mechanism comprises a connector link having a pair of opposed external boom pivot connections. Each of the booms has a pivot end connected spaced apart to a respective one of the external pivot connections. The connector link also has a pair of internal cylinder pivot connections spaced apart closer than the external pivot connections. The external boom pivot connections and the internal cylinder pivot connections are disposed on parallel axes spaced apart a distance not greater than the distance between the external boom pivot connections less the distance between the cylinder pivot connections. A first hydraulic cylinder is pivotally connected at one end to a first of the booms, and has a piston rod end connected to an associated one of the internal cylinder pivot connections. A second hydraulic cylinder is pivotally connected at one end to a second of the booms, and has a piston rod end connected to an associated one of the internal cylinder pivot connections. The cylinders and the booms are disposed in the same plane. A hydraulic circuit is provided for simultaneous synchronized operation of the cylinders to articulate one of the booms relative to the other along a common arc.

9 Claims, 3 Drawing Sheets

BOOM ARTICULATION MECHANISM WITH, SIMULTANEOUSLY OPERABLE, CYLINDERS

BACKGROUND OF INVENTION

1. Field of Invention

The present invention relates to vehicle aerial devices and more particularly to an improved mechanism which permits the articulation of an upper boom relative to a lower boom and utilizing two cylinders disposed in a vertical plane and connected to a respective one of the booms.

2. Description of Prior Art

Vehicle aerial devices usually consist of an upper boom equipped with a basket to carry a workman, a lower boom and a pedestal which is mounted on the bed of a truck. The upper and the lower booms could be both articulated by cylinders via a hydraulic control system that can also rotate the lower boom. They are used for a variety of applications where it is necessary to access locations remote from the ground, like the servicing of overhead power lines, for example. In this field of work, one of the major concern relates to the fact that workmen should be insulated from the ground as it is extremely hazardous to work close to transmission lines.

In order to protect workmen from electrocution, manufacturers of such devices provide an upper boom, a lower boom, or both booms made from insulated materials, the most common being fiberglass reinforced plastics.

The more insulation material used on the aerial device, the safer it is for the workman, as he is close to the transmission lines. In other words, a fiberglass boom which is longer means better insulation against electrocution. Most aerial devices use the four bar or the "scissors linkage" mechanism with a hydraulic actuator to raise or lower the boom. It is made of five parts; a cylinder, a lower boom arm, an upper boom arm and two different connecting links. Although this mechanism is relatively easy to maintain and capable of handling large loads for most of the operating range, the cylinder is usually quite long which makes the lower boom arm difficult to insulate. Another disadvantage of the mechanism relates to the forces acting on the components, especially on one of the connecting links, which vary rather widely as the angle of articulation changes and as a constant moment is applied.

Constant radius mechanisms using sprockets and chains or pulley and cables have also been employed to rotate the upper boom relative to the lower boom. Some advantages of this mechanism include large angle of rotation of about 270°, constant moment applied to the pulley or sprocket and constant angular velocity over the range of the articulation. However, such systems requires cumbersome assemblies with many pieces at higher production cost. The metal surface of the articulated mechanism exposed to the power lines is great with the lower insulated boom insert tending to be quite small. Further disadvantages include looseness between the sprocket and chain, susceptibility to wear and frequent maintenance.

SUMMARY OF INVENTION

It is a feature of the present invention to improve safety by using a compact articulated mechanism so that the insulated upper and lower booms may be made longer.

A further feature is to provide a mechanism that is simpler to produce than other known mechanisms using both the four bar and the constant radius mechanism.

Another feature is that, seeing that both cylinders and both the lower boom arm and the upper boom arm are identical, the number of different parts to produce is less than for other known type mechanism.

Another feature is that the hydraulic cylinders are activated by a common hydraulic control system which includes two flow dividers. These flow dividers insure that each cylinder receives the same flow in order to move simultaneously. There are two main advantages to utilize such a system.

1. By moving both cylinders simultaneously, symmetrical forces are generated in each cylinder. For constant moment over a full rotation of the upper boom, the force is maximum at the beginning of the arc and minimum at half the rotation (this is due to the geometry of the mechanism). Although the maximum force on each cylinder happens at the opening of the mechanism, this is no problem since the heavy loads are manipulated near the center of the arc or what we could call "work positions". It is evident from our observation of the prior art that a sequential operation of the cylinders (opening of the cylinder fixed to the upper boom arm before opening the one fixed to the lower boom arm) would bring a situation where an excessive force would be applied on the closed cylinder as we reach a working position.

2. The simultaneous movement of both cylinders has another advantage regarding the general motion of the aerial device; it brings a constant motion along the same arc over the entire rotation of the upper boom. It would not be the case for a sequential motion of each cylinder as the upper boom would be pivoted around a first point when operating the upper cylinder and a second point when operating the lower cylinder.

Another feature of the present invention is to provide a symmetrical design with equivalent forces applied at each cylinder as a constant moment is applied to the mechanism. Also, since the cylinders and the booms are disposed in the same plane, there is no torsion induced on the mechanism.

A further feature is to provide a mechanism with simple components which are low in cost and require minimal maintenance.

According to the above features, from a broad aspect, the present invention provides a boom articulation mechanism for interconnecting and displacing a pair of boom members. The mechanism comprises a connector link having a pair of opposed external boom pivot connections. Each of the booms has a pivot end connected spaced apart to a respective one of the external pivot connections. The connector link also has a pair of internal cylinder pivot connections spaced apart closer than the external pivot connections. The external boom pivot connections and the internal cylinder pivot connections are disposed on parallel axes spaced apart a distance smaller than the distance between the external boom pivot connections less the distance between the cylinder pivot connections. A first hydraulic cylinder is pivotally connected at one end to a first of the booms, and has a piston rod end connected to an associated one of the internal cylinder pivot connections. A second hydraulic cylinder is pivotally connected at one end to a second of the booms, and has a piston rod end connected to an associated one of the internal cylinder pivot connections. The cylinders and the booms are disposed in the same plane A hydraulic circuit is provided for simultaneous synchronized operation of the cylinders to articulate one of the booms relative to the other along a common arc.

BRIEF DESCRIPTION OF DRAWINGS

A preferred embodiment of the present invention will now be described with reference to the accompanying drawings in which.

DESCRIPTION OF PREFERRED EMBODIMENTS

Figure 1:
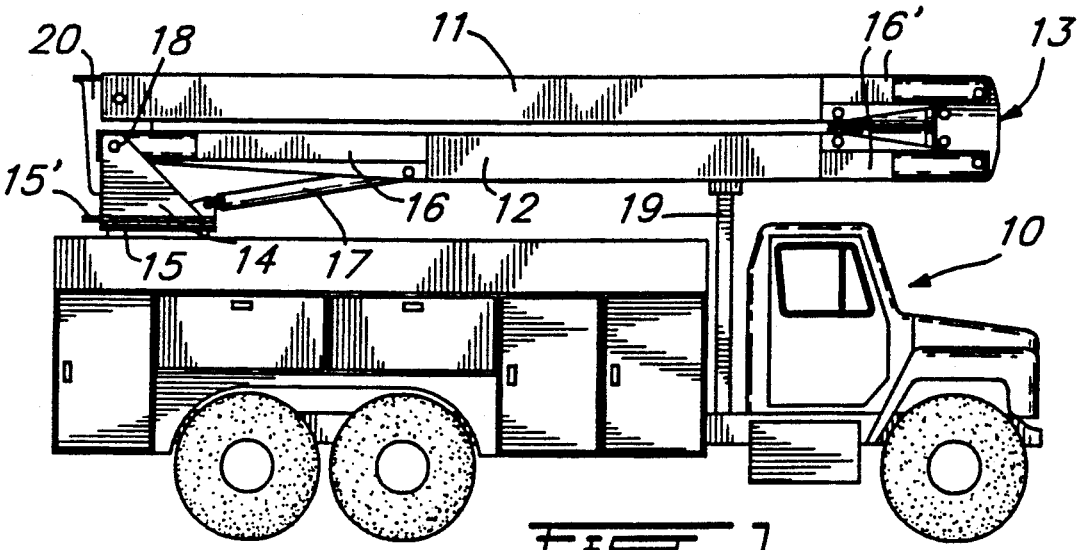
FIG. 1 is a side elevational view showing a vehicle aerial device equipped with the boom articulation mechanism of the present invention.

Referring now to the drawings, and more particularly to FIG. 1, there is shown a vehicle 10 on which is secured an aerial device comprising a lower insulated fiberglass boom 12 and an upper insulated fiberglass boom 11 interconnected together by a boom articulation mechanism 13. The lower boom 12 is connected to a turret frame 14 which is connected to a vehicle pedestal 15 via a turntable bearing 15'. The lower boom has a lower boom section 16, usually constructed of steel, which is hinged to the turret frame 14 and displaceable by a hydraulic cylinder 17 which is connected between the turret frame 14 and a forward portion of the lower boom section 16 whereby to displace the lower boom on its lower pivot connection 18. A support post 19 supports the lower boom in a substantially horizontal plane when the lower boom is not displaced. A workman support basket 20 is pivotally connected to the free end of the upper boom 11.

Figure 2:
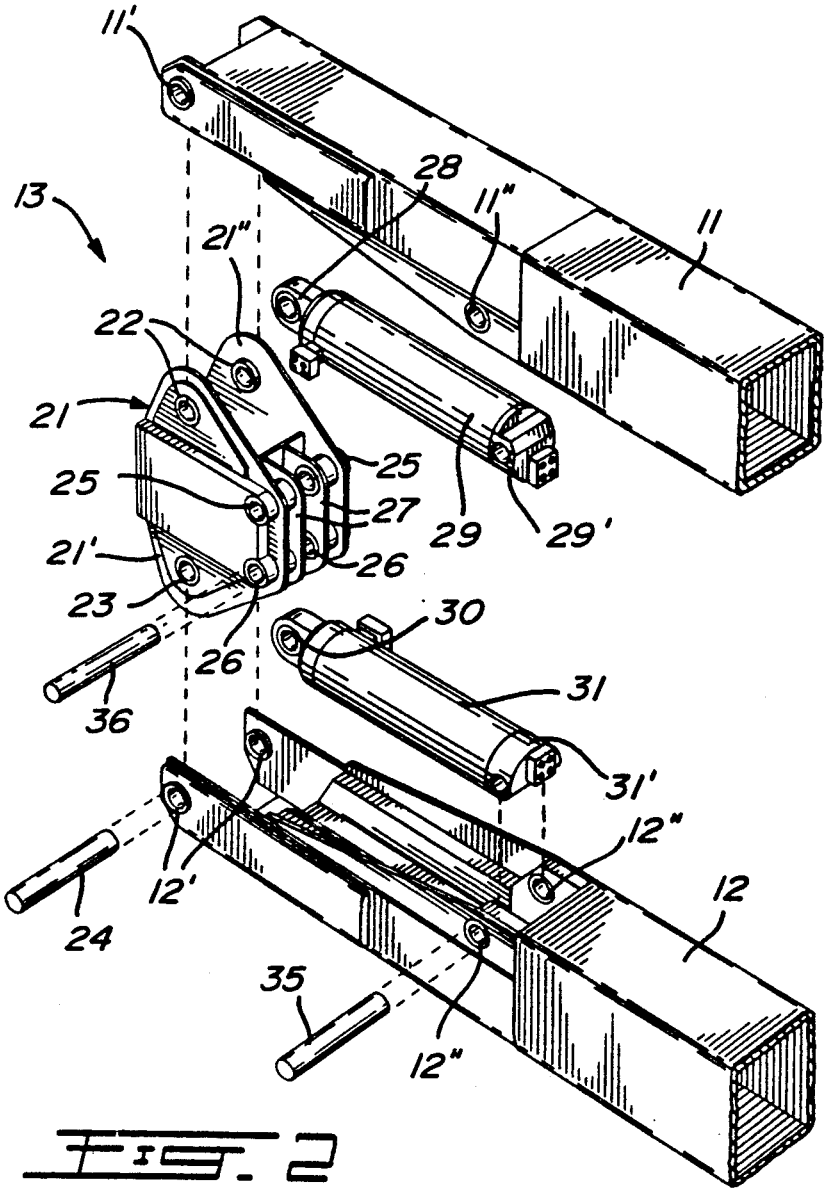
FIG. 2 is an exploded fragmented perspective view showing the principal components of the articulation mechanism.
Figure 3A:
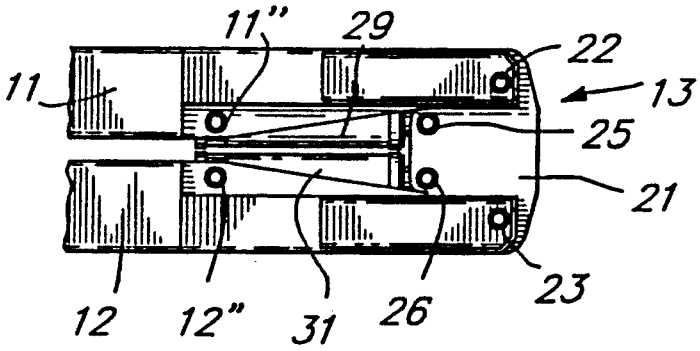
FIGS. 3A, 3B and 3C are fragmented side elevation views illustrating the respective positions for different angles of the upper boom arm and the simultaneous movement of both cylinders.
Figure 3B:
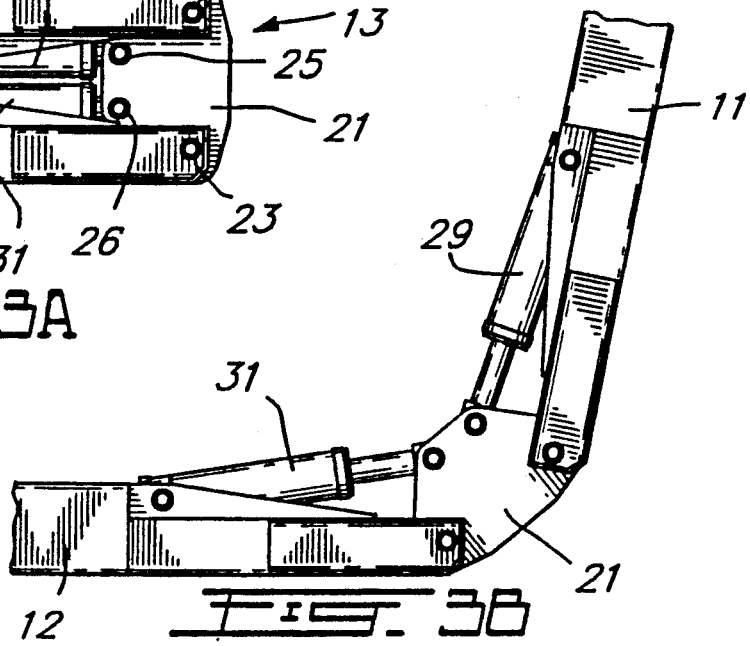
Figure 3C:
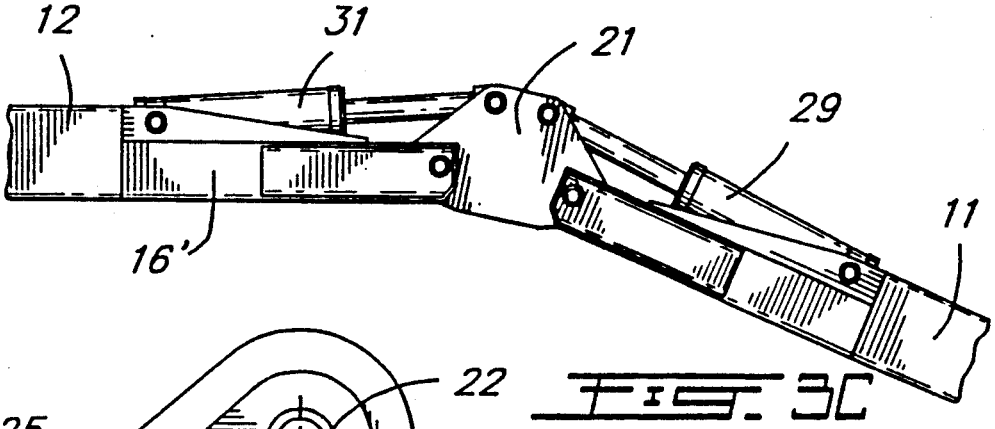
Figure 4:
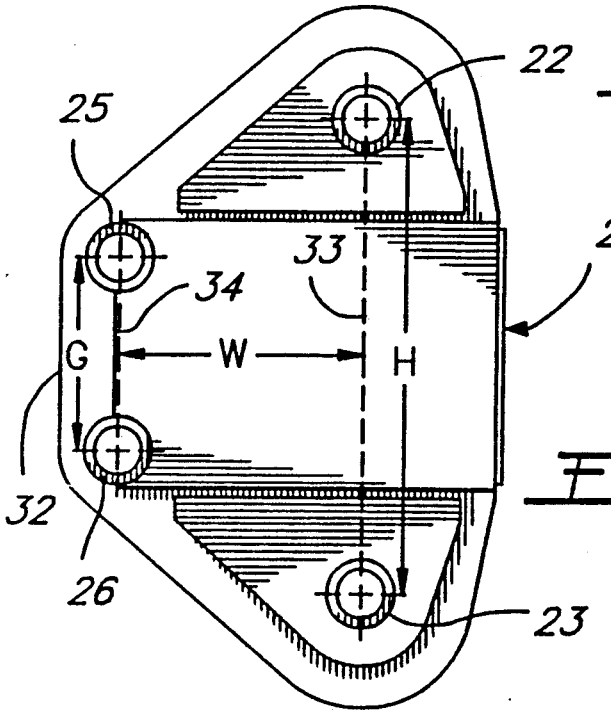
FIG. 4 is a side elevation view showing the relationship between defined parameters.

Referring now additionally to FIGS. 2 to 4, there will be described the construction of the boom articulation mechanism 13 of the present invention. As is more clearly shown in FIG. 2, boom articulation mechanism 13 comprises a connector link 21 which is comprised of a pair of delta-shaped plates 21' and 21" which are spaced apart and which provide an articulated interconnection between the upper boom 11 and lower boom 12. The connector link 21 has a pair of opposed external boom pivot connections 22 and 23 spaced apart and located in the widest section of the delta at a distance H (see FIG. 4). The pivot connection 22 consists of transversely aligned holes provided in the plates 21' and 21" for receiving therein a pivot pin, such as pivot pin 24 which also passes through the pivot holes 11' in the boom 11 and holes 12' in the boom 12 to provide a pivot end connection of these booms. The connector link 21 also has a pair of internal cylinder pivot connections 25 and 26, also in the form of aligned holes, in the opposed plates 21' and 21" and further extending through internal spacer plates 27 to interconnect the piston rod 28 end of the upper boom cylinder 29 and the piston rod end 30 of the lower boom cylinder 31. These internal connections 25 and 26 are spaced closer together adjacent the apex end 32 of the connector link 21 a distance G.

As can be seen from FIG. 4, the external boom pivot connections 22 and 23 and the internal cylinder pivot connections 25 and 26 are disposed on parallel planes 33 and 34, respectively, which planes are spaced apart a distance W which is not greater than the distance H between the external boom pivot connection axes 22' and 23' less the distance G between the connection axes 25' and 26' of the internal cylinder pivot connections. Combines with the use of identical metallic sections 16', such symmetrical disposition of the four pivot connections is essential for the simultaneous synchronized operation of the cylinders 29 and 31 to always articulate booms 11 and 12 the same angle relative to the delta and to articulate the booms 11 and 12 relative to one another along a common arc, as will be described later with respect to the FIGS. 3A to 3C. Also, it is pointed out that because of the relationship of the parameters H, W and G, as abovementioned, relatively short and small in diameter cylinders 31 can be utilized. By using shorter cylinders it is possible to utilize shorter metal sections 16' and therefore longer fiberglass booms 12. Thus, the aerial device is also much safer as it is better insulated.

As can be seen more clearly from FIGS. 3A to 3C, the upper boom cylinder 29 is pivotally connected at its cylinder end 29' to a pivot connection 11" on the upper boom. Similarly, the lower boom cylinder 31 has its cylinder end 31' pivotally connected to the pivot connection 12" of the lower boom. A pivot pin 35 provides for such connection. The piston rod ends 28 and 30 of the cylinders 29 and 31 are also pivotally connected to the respective one of the internal cylinder pivot connections 25 and 26 by means of pivot pins, such as pivot pin 36, which extends between the delta plates 21' and 21" and the inner spacer plates 27. Thus, the cylinders 29 and 31 and the booms are disposed in the same plane.

Figure 5:
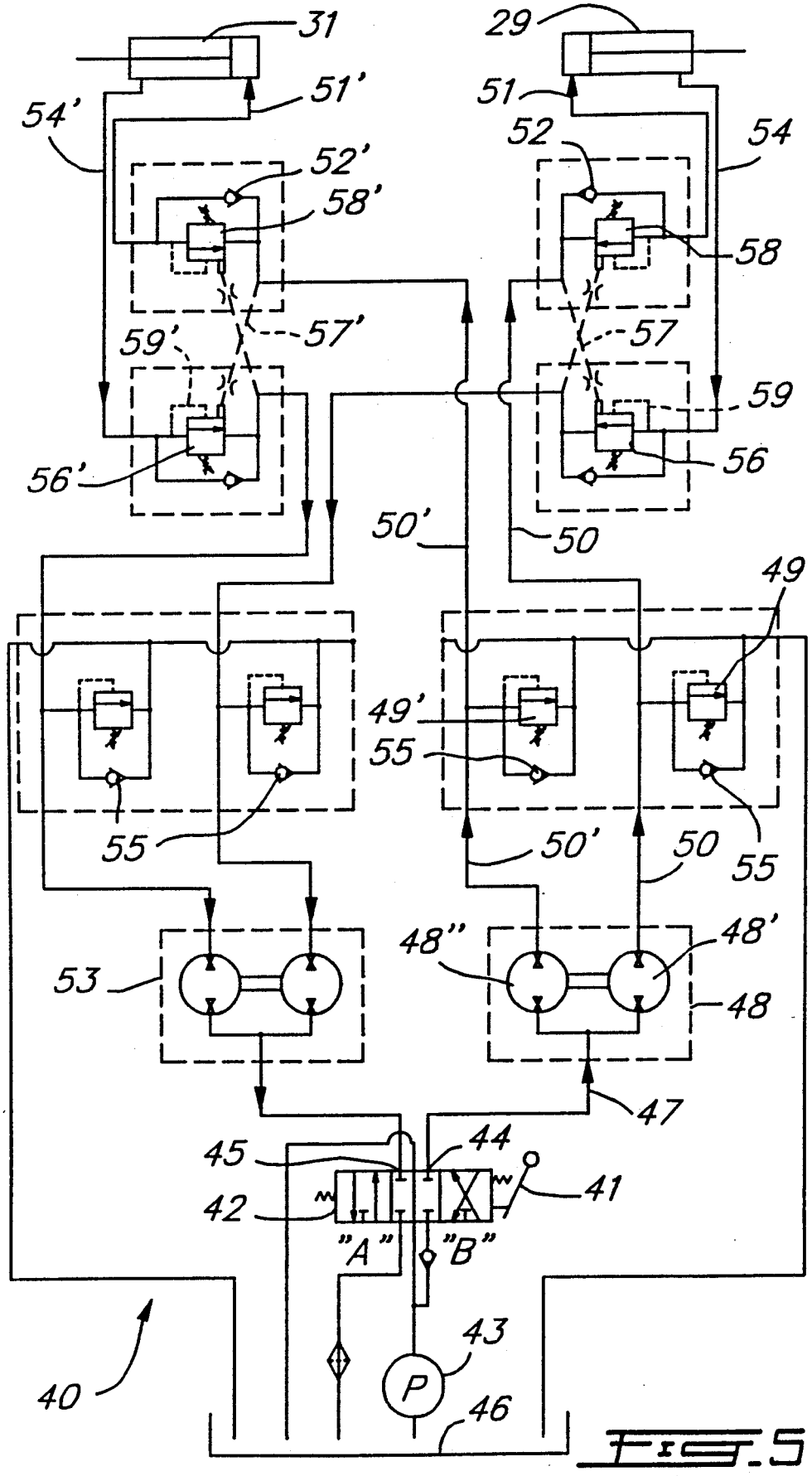
FIG. 5 is a schematic drawing of the hydraulic circuit controlling the cylinders.

Both of the hydraulic cylinders 29 and 31 are activated by a common hydraulic control system, as illustrated in FIG. 5 and which will be described in detail hereinbelow. This hydraulic control system ensures that each cylinder 29 and 31 receives the same flow in order for its piston rod end to be extended substantially simultaneously in synchronism or substantially at the same rate. By moving these cylinders simultaneously symmetrical forces are generated in each cylinder. For a constant moment over a full rotation of 210° of the upper boom, as shown in FIG. 3C, the force is maximum at the beginning of the arc of rotation of the upper boom and minimum at half the rotation, i.e., substantially vertical extension. Although the maximum force on each cylinder occurs at the opening of the boom articulation mechanism 13, this is no problem since the heavy loads are manipulated near the center of the arc. The simultaneous activation of the cylinders also provides a constant motion between the booms along the same arc over the entire rotation of the upper boom.

Referring now to FIG. 5, there is shown the hydraulic circuit required in order to have a synchronized operation of both cylinders 29 and 31 which are schematically illustrated in the circuit diagram. By moving a control lever 41 of the control valve 42 into position A, a fluid pump 43 is connected to port 44 of the valve. Port 45 is connected to the reservoir 46. When the valve 42 is in position B port 44 is connected to the reservoir 46 and port 45 is connected to the pump 43, as indicated by the symbols at position B.

As can be seen in this drawings, port 44 is connected via fluid line 47 to a flow divider 48 where the flow is divided by two rotary gear sections 48' and 48" which provide a high accuracy of flow division. Associated pressure relief valves 49 and 49' are connected to the respective fluid lines 50 and 50' at the output of the gear sections 48' and 48" to compensate for errors in the synchronization of the operation of the cylinders. Because one of the cylinders can be completely opened before the other, when this occurs, the pressure increases on the cylinder that is open and the pressure relief valve associated therewith will return the oil to the reservoir to permit the other piston to attain its final position. The fluid lines 50 and 50' connect respectively to the piston side of the cylinders 29 .and 31 as indicated by fluid lines 51 and 51' through check valves 52 and 52'. Both cylinders 29 and 31 move at the same pace as the rotary flow divider 48 provide high accuracy of flow division. When the fastest cylinder arrives at the end of the run, the flow sent to it by the divider is sent off to the reservoir through the corresponding relief valve allowing the slower cylinder to reach the end of the run. Also, in this phase it will be noted that the flow divider 53 acts as a recombiner as the separate flows coming out of the cylinders through flow lines 54 and 54' are combined into a single flow. When one of the cylinders reaches the end of its run the corresponding section of the flow divider 53 continues to take in oil from the reservoir through the make-up valves 55 allowing the slower cylinder to reach the other.

Port mounted counterbalance valves 56 and 56' are provided with free-flow check valves and secured to the cylinder end fluid flow lines 54 and 54' to prevent jerkiness motion of the upper boom, as both cylinders go suddenly from compression to tension. Such counterbalance valves are also connected to the piston side fluid flow lines 51 and 51'. These valves are indicated by reference numerals 58 and 58'. This jerkiness motion usually occurs when the upper boom goes past the vertical position and reaches an over center position. Since they are mounted directly on the cylinders, the hydraulic pressure would be maintained in case of a line failure and prevent collapsing of the booms.

As discussed hereinabove, the fluid flow from the gear sections 48' and 48" flows through the check valves 52 and 52' and applies pressure to the piston side of the cylinders. The pressure in lines 50 and 50' is transmitted through pilot lines 57 and 57' to counterbalance holding valves 56 and 56', respectively. When the pressure is high enough, the valves 56 and 56' are moved to the open position to connect the rod side of its associated cylinders 29 and 31, respectively, to the reservoir 46. Valves 56 and 56' can also be opened by another pilot line 59 and 59', respectively, which prevents excessive pressure from being applied to the rod end of the cylinder.

When the cylinders 29 and 31 reach the end of their stroke, they can be reversed by simply moving the control lever 41 to position B to reverse the connection of ports 44 and 45 from the pump and the reservoir, respectively.

It is within the ambit of the present invention to cover any obvious modifications of the preferred embodiment described herein, provided such modifications fall within the scope of the appended claims.

I claim:

1. A boom articulation mechanism for interconnecting and displacing a pair of boom members, said mechanism comprising a connector link having a pair of opposed external boom pivot connections, each said boom having a pivot end connected spaced apart to a respective one of said external pivot connections, said connector link also having a pair of internal cylinder pivot connections spaced apart closer than said external pivot connections, said external boom pivot connections and said internal cylinder pivot connections being disposed on parallel planes which are spaced apart a distance not greater than the distance between both external boom pivot connection axes less the distance between both cylinder pivot connection axes, a first hydraulic cylinder pivotally connected at one end to a first of said booms and having a piston rod end connected to an associated one of said internal cylinder pivot connections, a second hydraulic cylinder pivotally connected at one end to a second of said booms and having a piston rod end connected to an associated one of said internal cylinder pivot connections, said cylinders and said booms being disposed in the same plane, and a hydraulic circuit for simultaneous synchronized operation of said cylinders to articulate one of said booms relative to the other along a common arc, said hydraulic circuit having a control valve provided with a first port connected to a piston side of both said cylinders and a second port connected to a rod side of said cylinders, said control valve selectively connecting said ports to either a hydraulic pump or a hydraulic reservoir of aid hydraulic circuit, and flow control means for synchronous displacement of the respective piston in said cylinder.

2. A boom articulation mechanism as claimed in claim 1 wherein said connector link is a delta-shaped connector link having a pair of spaced parallel plates, said piston rod ends being connected centrally between said plates on pivot pins near an apex portion of said plates, said boom pivot connections being disposed near a base end of said plates.

3. A boom articulation mechanism as claimed in claim 1 wherein said booms are constructed in a major part of insulated material, each boom having a short end arm metal section connected to said connector link, said cylinder being pivotally connected between said end arm section and said connector link.

4. A boom articulation mechanism as claimed in claim 3 wherein a lower one of said booms is connected to a turret frame which is connected to a vehicle pedestal via a turntable bearing, said lower boom having a lower metal boom section connected on a hinge to said turret frame and displaceable by a hydraulic cylinder connected between said turret frame and a forward portion of said lower boom section.

5. A boom articulation mechanism as claimed in claim 1 wherein said flow control means comprises a pair of rotary flow dividers connected to each said first and second port and pressure relief valves to provide substantially equal flow division of hydraulic fluid to said piston side and rod side of both said cylinders.

6. A boom articulation mechanism as claimed in claim 5 wherein said rotary flow divider is connected to said port which is branched to said reservoir acts as a combiner, said flow control means further comprising make-up valves allowing a slower cylinder to take up hydraulic fluid when a first cylinder piston has reached an end of travel.

7. A boom articulation mechanism as claimed in claim 5 wherein there is further provided counterbalance holding valves connected to each cylinder end and piston side fluid flow lines to prevent jerkiness motion as both cylinders change from compression to tension.

8. A boom articulation mechanism as claimed in claim 7 wherein each said free flow check valve forms part of a respective counterbalance holding valve, a pilot line connecting said holding valve to a hydraulic line interconnecting each flow divider to said free flow check valve, one of said two holding valves associated with each piston being operated by a predetermined pressure in the other hydraulic line to connect an opposed side of said cylinder to be connected to said reservoir.

9. A boom articulation mechanism as claimed in claim 8 wherein said counterbalance holding valves are each provided by an over-pressure pilot line to prevent excessive pressure from being applied to either the piston or rod ends of said cylinders.

* * * * *